US006648719B2

(12) United States Patent
Chan

(10) Patent No.: US 6,648,719 B2
(45) Date of Patent: Nov. 18, 2003

(54) INTERACTIVE DOLL AND ACTIVITY CENTER

(75) Inventor: Albert Wai Chan, Hong Kong (CN)

(73) Assignee: Thinking Technology, Inc., Nassau (BS)

( * ) Notice: Subject to any disclaimer, the term of this patent is extended or adjusted under 35 U.S.C. 154(b) by 0 days.

(21) Appl. No.: 09/837,338

(22) Filed: Apr. 19, 2001

(65) Prior Publication Data

US 2001/0041495 A1 Nov. 15, 2001

Related U.S. Application Data

(60) Provisional application No. 60/200,326, filed on Apr. 28, 2000.

(51) Int. Cl.[7] ..... A63H 3/28

(52) U.S. Cl. ..... 446/297; 446/484

(58) Field of Search ..... 446/268, 296, 446/297, 298, 304, 305, 484

(56) References Cited

U.S. PATENT DOCUMENTS

| | | | | |
|---|---|---|---|---|
| 6,110,000 A | * | 8/2000 | Ting | 446/175 |
| 6,135,845 A | * | 10/2000 | Klimpert et al. | 446/297 |
| 6,264,523 B1 | * | 7/2001 | Simmons | 434/169 |
| 6,364,735 B1 | * | 4/2002 | Bristow et al. | 446/297 |
| 6,380,844 B2 | * | 4/2002 | Pelekis | 340/5.8 |

* cited by examiner

*Primary Examiner*—Jacob K. Ackun
(74) *Attorney, Agent, or Firm*—Kramer & Amado, P.C.; Gordon J. Zimmerman, Esq.

(57) ABSTRACT

A doll and a doll activity center are adapted to communicate with each other with respect to the status of the doll or the activity center, and either the doll or the activity center is adapted to generate an audible comment respecting said status.

23 Claims, 10 Drawing Sheets

INTERACTIVE DOLL AND ACTIVITY CENTER

This application claims the benefit of provisional application No. 60/200,326 filed Apr. 28, 2000

BACKGROUND OF THE INVENTION

For many years, dolls and toys have been sold together or separately with activity centers. One of the oldest examples of an activity center is a doll house. A child can take a doll and place it in proximity to an activity center in order to generate a scenario from the child's imagination. The doll or toy can be placed in a doll house, in a motor vehicle, in a kitchen, in a grocery store, on a fashion runway, or in any other activity center environment.

One disadvantage of this arrangement, however, is that the doll and activity center do not interact such that either one can signal the presence of the other to the child playing with the doll or toy. This is left to the child's imagination.

SUMMARY OF THE INVENTION

Accordingly, it would be advantageous to provide a doll and a doll activity center adapted to communicate with each other.

In a broad aspect, the doll and doll activity center of the present invention are adapted to communicate with each other with respect to the status of the doll or of the activity center, and either the doll or the activity center is adapted to generate an audible comment respecting said status.

In further aspects of the invention:

(a) the activity center is adapted to recognize at least one removable accessory;
(b) the activity center is adapted to signal the status of said accessory to the doll;
(c) the doll is adapted to indicate the status by making a preprogrammed comment;
(d) the doll and activity center comprises multiple removable accessories;
(e) the preprogrammed comment is chosen from a series of stored comments;
(f) the series of comments is stored on an integrated circuit chip;
(g) the audible comment comprises artificial speech;
(h) the audible comment is stored on an integrated circuit chip;
(i) the audible comment generated indicates whether the status is acceptable or not acceptable;
(j) the audible comment generated indicates whether the chosen accessory is acceptable or not acceptable;
(k) the activity center comprises a fashion runway;
(l) the activity center comprises a kitchen;
(m) the activity center comprises a shopping market;
(n) the activity center comprises an automobile;
(o) the accessory comprises a series of pins and the activity center comprises a series of receptacles adapted to receive such pins such that the activity center recognizes the accessory by means of the specific arrangement of said pins and receptacles and the contact therebetween;
(p) the accessory comprises one or more areas adapted to absorb or reflect an electromagnetic signal generated by the activity center, such that the activity center recognizes the accessory by means of the specific arrangement of said absorbing and reflecting areas.

DETAILED DESCRIPTION OF THE INVENTION

The invention involves electronic dolls and electronic doll activity centers. The doll and activity center of the invention may comprise any suitable combination of these elements.

Figure 1:
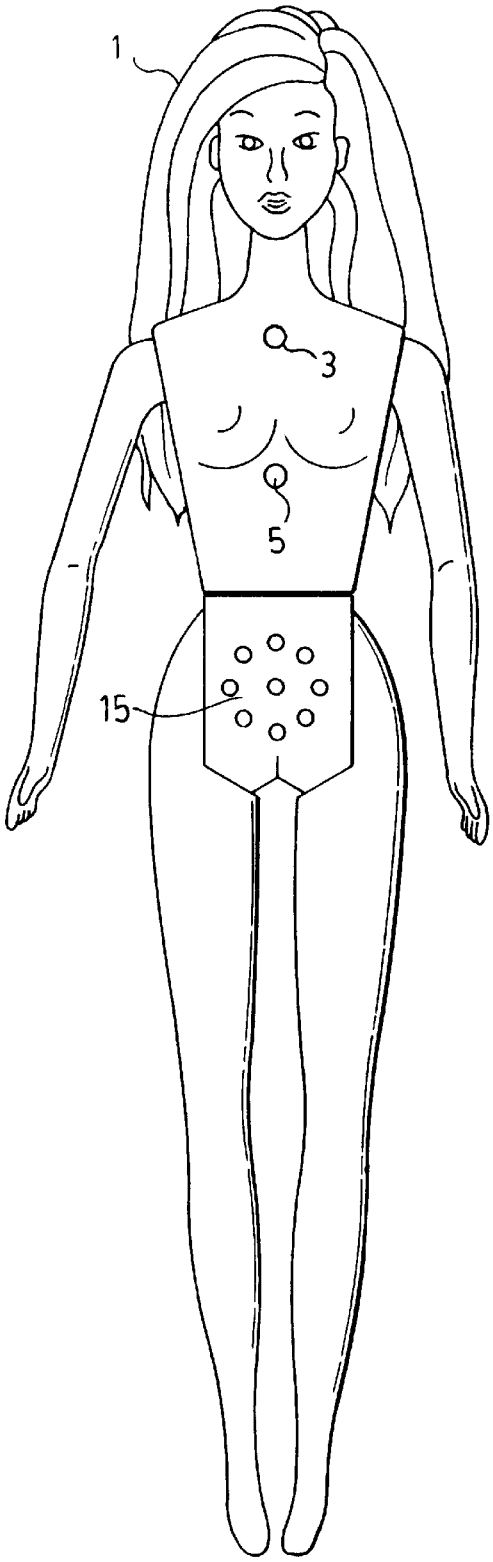
FIG. 1 is a front view of a doll adapted for interaction with an activity center.

Referring to FIG. 1, the electronic doll 1 of this invention comprises transmitting means 3 and receiving means 5. The transmitting and receiving means, in the illustrative embodiment, are respectively adapted to transmit and receive infrared signals, although other suitable electromagnetic frequencies maybe employed. The doll is also provided with, and controlled by, an integrated circuit (not shown), or a series of integrated circuits, with pre-programmed functions. The doll is adapted to transmit information respecting its status, and to receive information about the status of other dolls, or of activity centers.

Figure 2:
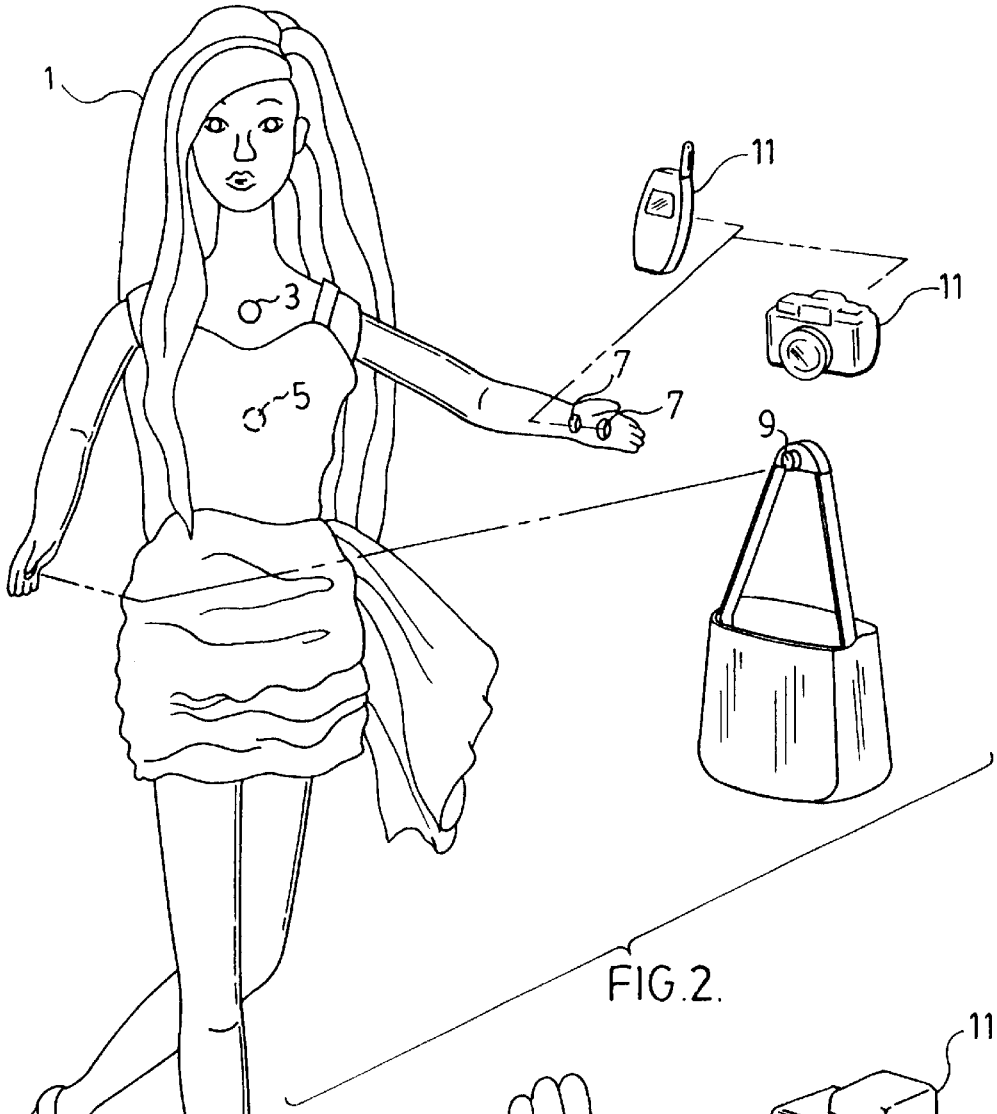
FIG. 2 is a perspective schematic view of a doll with doll accessories.
Figure 3:
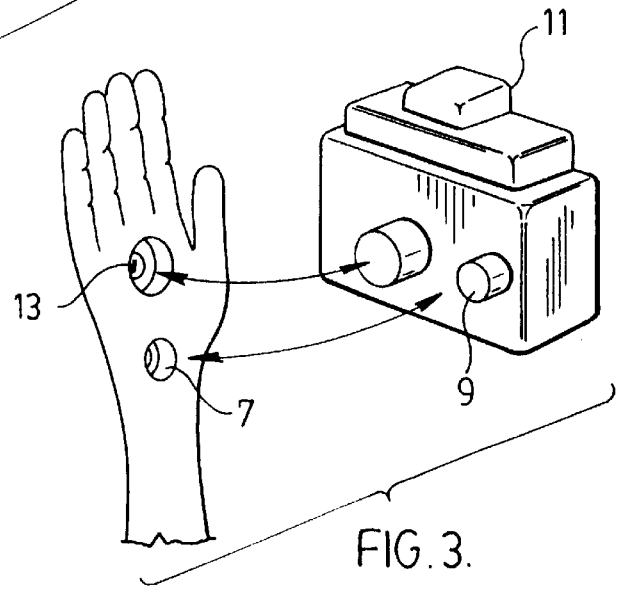
FIG. 3 is a partially cut-away schematic representation of a doll hand with pin receptacles and an accessory with pins.

In a preferred embodiment, the doll is also provided with means to recognize accessories. As illustrated in FIGS. 2 and 3, in a typical embodiment, the doll is provided with a series of openings or receptacles 7 which correspond to pins 9 mounted on a number of accessories 11. Electrical contacts or switches 13 below the surface of the doll contact one or more pins of such accessories in a unique way, so that the doll can react to the accessory in a unique pre-programmed way when the doll and an accessory are so joined.

Typically, the doll is pre-programmed to generate simulated speech. An audio speaker is located below sound openings 15 on the surface of the doll. The speech is typically recorded and stored on one or more integrated circuits (not shown) within the doll. When a particular combination of interactions between doll and accessories, doll and activity center, one doll and another doll, activity center and accessory, or all of the above occurs, appropriate comments using such pre-recorded speech can be generated.

Figure 4:
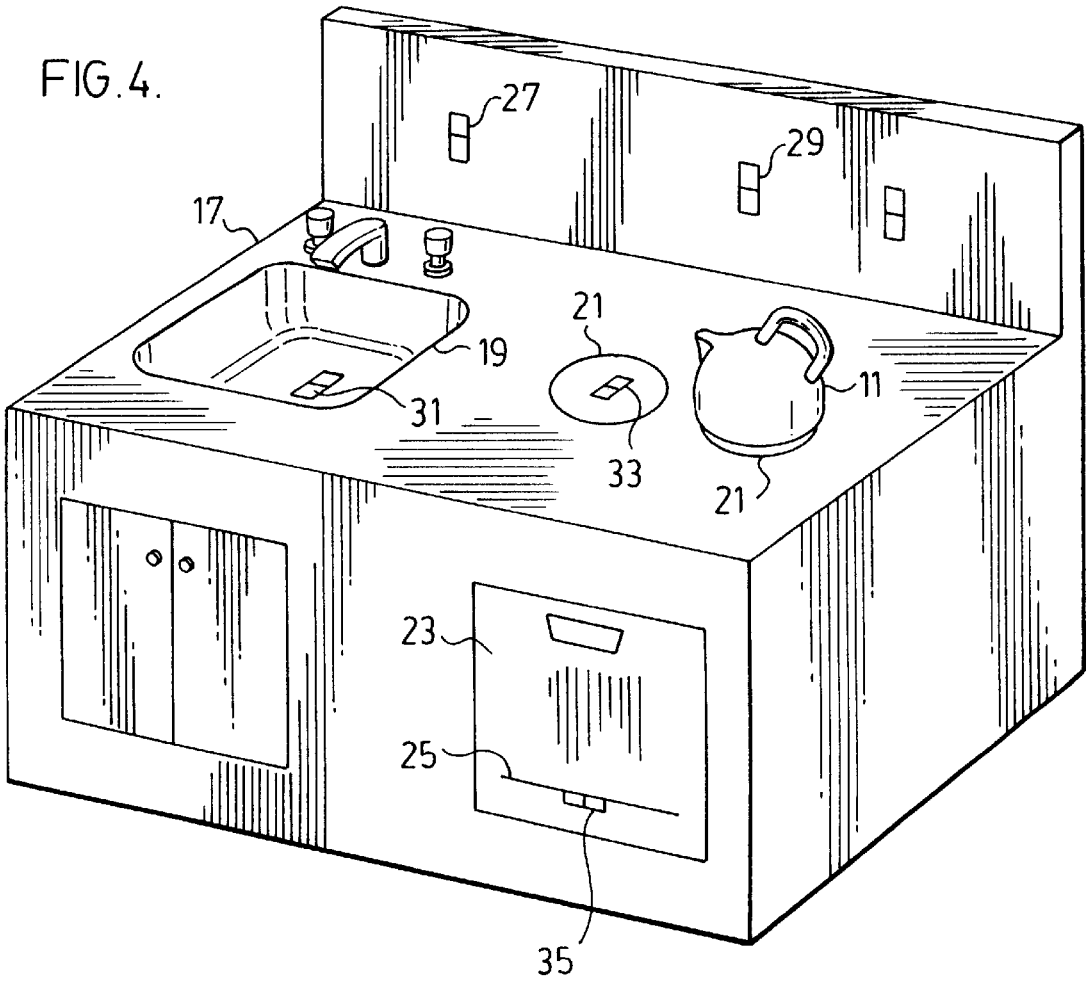
FIG. 4 is a perspective view of a kitchen activity center.

For example, the doll may function as a homemaker and the activity center may be a kitchen environment as illustrated in FIG. 4. The kitchen activity center 17 comprises a sink 19, burner or stove top elements 21, and oven 23 with an oven rack 25. An infrared transmitter 27 is adapted to transmit infrared signals to the doll, while an infrared receiver 29 is adapted to receive such signals from the doll.

When the doll is placed close to the kitchen activity center, sensor 5 on the doll recognizes this status. The doll may be preprogrammed with artificial speech. The doll can then make a statement indicating that it is near the kitchen and that some activity should be undertaken. The doll may invite the child playing with the doll to, for example, change the doll's clothing to something more suitable to the kitchen environment, provide the doll with an accessory like a dish towel or apron, wash up the dishes by placing a set of toy dishes in the sink, put something into the oven to bake, or cook something on the stove top.

The activity center is provided with its own set of sensors adapted to recognize various accessories which may be placed upon it. For example, if washing the dishes is the desired activity, the activity center is adapted to recognize when the appropriate accessory, such as dishwashing detergent or a stack of dishes, is placed in the appropriate location, such as a sink.

Figure 6A:
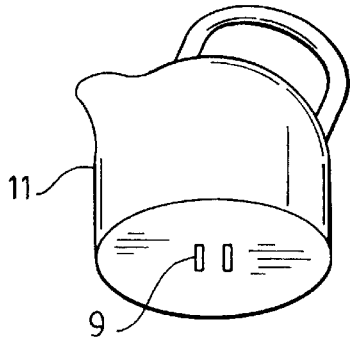
FIGS. 6A, 6B, 7A and 7B illustrate stove-top accessories with pins or marks to be sensed by the activity center.
Figure 7A:
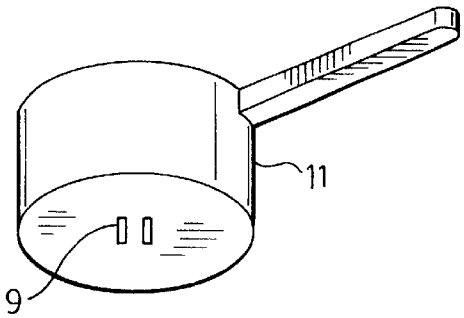

The recognition means may comprise any suitable means. A very simple means would comprise a magnetic switch which will merely signal on or off depending on whether an accessory with a metal element is nearby. More sophisticated recognition means may comprise a series of pins and receptacles either on the activity center or the accessory, in a manner analogous to that illustrated for the doll and accessory combinations in FIGS. 2 and 3. Pin 9 arrangements on stove top, sink, or oven accessories are illustrated in FIGS. 6A and 7A. When the accessory is placed in contact with the activity center, the pins and receptacles correspond in such a way that the activity center recognizes the particular accessory.

Figure 5A:
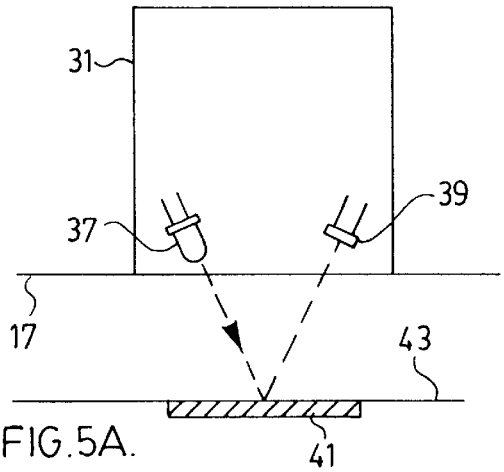
FIGS. 5A, 5B and 5C are schematic representations of an infrared sensor array with a source, a detector and a surface.
Figure 5B:
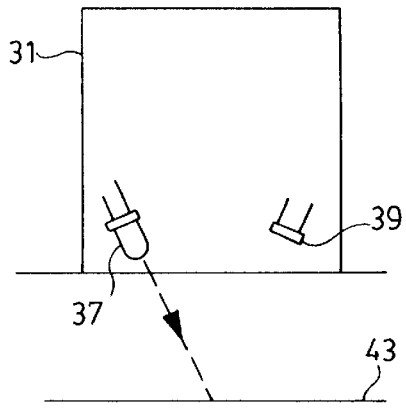
Figure 5C:
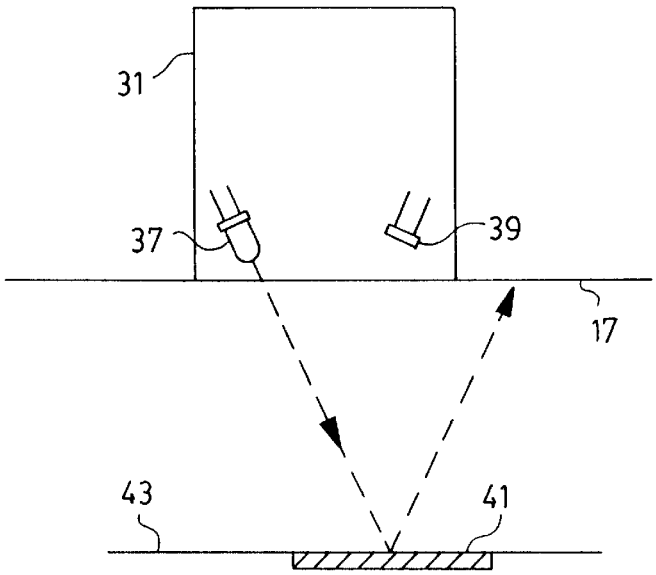
Figure 6B:
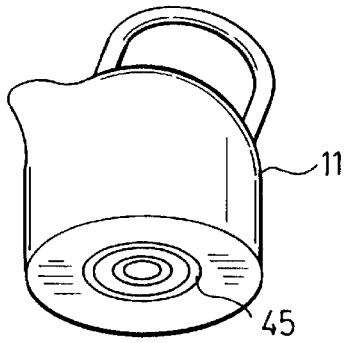
Figure 7B:
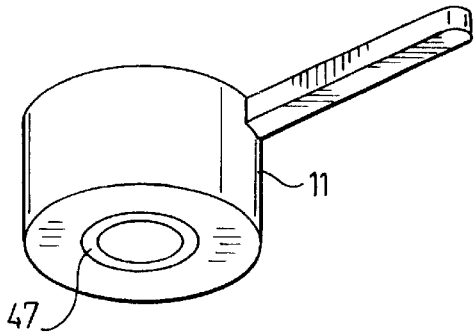

In a further alternative, the activity center may be provided with electromagnetic sensor means 31, 33 and 35 each comprising a source of electromagnetic energy and a detector of such energy, as illustrated in FIGS. 5A, 5B and 5C. In this sensor arrangement, infrared light may be emitted from a source portion 37 of the sensor and received through a detector portion 39 of the sensor. When the light is reflected from a reflective surface 41 on a portion of the accessory, this will be detected. Alternatively, when no light is reflected from a non-reflective portion or surface 43 of the accessory, the lack of signal may have meaning in terms of the accessory being present or absent. When a pattern of such signals is created, such as by the use of a particular mark on the accessory 11 comprising areas of reflective and non-reflective material, as illustrated in FIGS. 6B and 7B, sophisticated recognition of multiple accessories in multiple locations on the activity center can be achieved.

In a preferred embodiment, the activity center sends a signal, typically through electromagnetic means such as an infrared signal, to the doll. The doll comprises a detector which can recognize the signal indicating that a particular accessory has been placed on the activity center. The doll is then triggered to make one of a series of pre-recorded comments appropriate to the accessory which has been placed on the activity center. The comment may indicate that an appropriate accessory has been chosen, or, alternatively, that an inappropriate accessory has been chosen. In this manner, the child playing with the doll and activity center will truly appear to interact with the doll since the doll will comment on the choices made by the child.

Multiple doll comments can be stored on modem integrated circuit chips. The preferred comments are statements comprising artificial speech.

Figure 8:
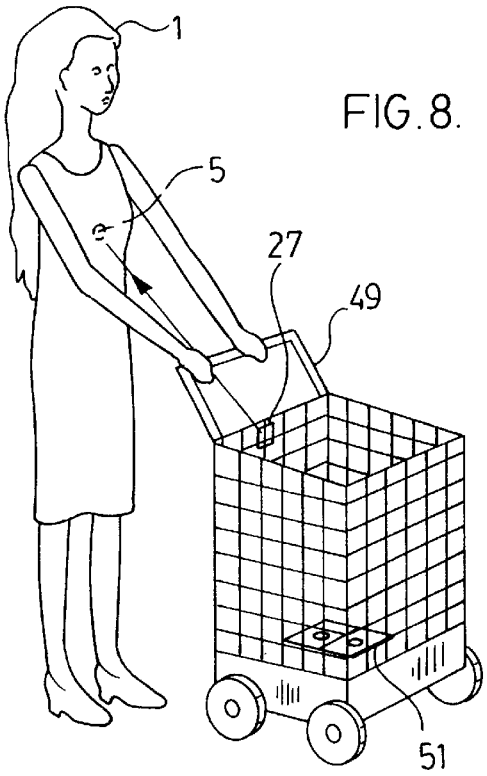
FIG. 8 is a schematic representation of a doll and shopping cart.

Other examples of activity centers include a shopping market. As illustrated in FIG. 8, the doll 1 can push a shopping cart 49. If the doll and shopping cart are provided with receptacles and pins as illustrated in FIG. 2, then the doll will be triggered to speak about activities involving the shopping cart. In addition, the shopping cart basket itself can be provided with openings to receive pins from other accessories, such as items to be purchased in the store.

Alternatively, the shopping cart may be provided with a sensor 51 located at the base of the shopping cart basket, adapted to recognize marks on such items to be purchased. When the shopping cart 49 is additionally provided with an integrated circuit (not shown) and a transmitter 27, information respecting the accessory present in the shopping cart can be transmitted to be received by the doll's receiver 5. This triggers the doll to generate an audible comment from its store of pre-recorded comments, respecting the particular item purchased in the store being sensed by the shopping cart sensor. Such items could be simulated food or other simulated items like the kettle or pot 11 illustrated in FIGS. 6A, 6B, 7A and 7B, which could also be suitable for stove top use, as previously described.

Figure 9:
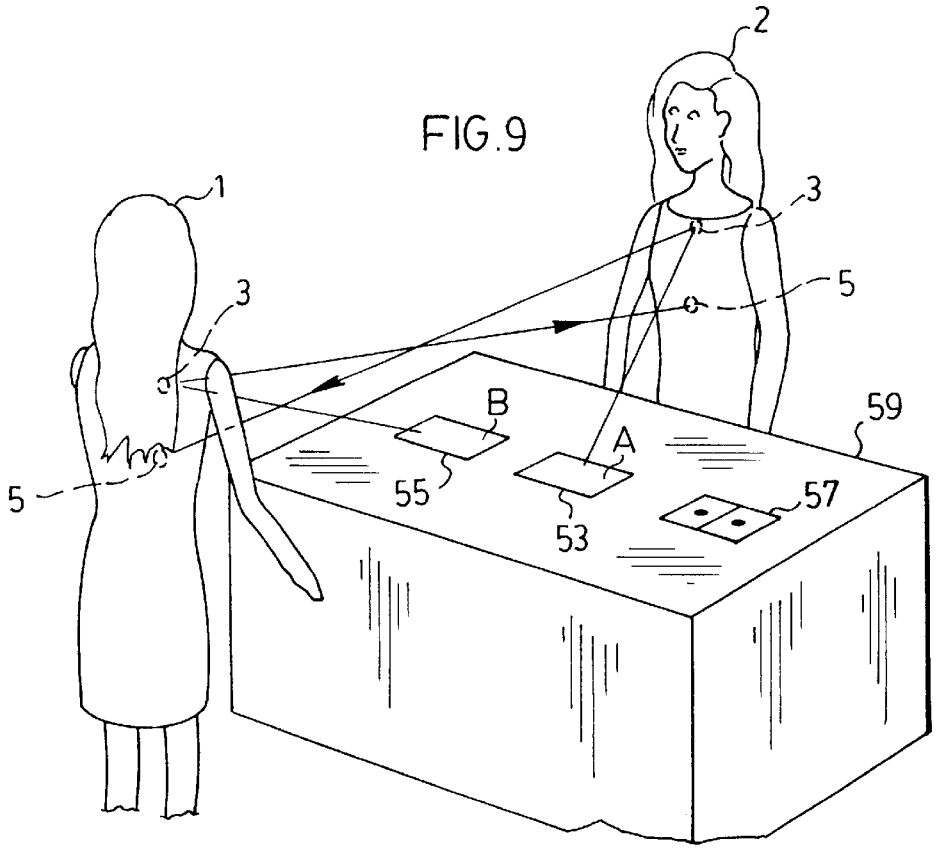
FIG. 9 is a schematic representation of two dolls and a shopping check-out counter activity center.

Alternatively, referring to FIG. 9, items 53 and 55 chosen by the first doll 1 can be placed on a sensor 57 mounted in check-out counter 59 in the shopping market. When an accessory, comprising a grocery or other item to be purchased, is placed in proximity to the sensor, the sensor will identify it and can trigger the second doll 2 to make an appropriate comment. In this activity center, multiple dolls may be employed. Each of dolls 1 and 2 may transmit information from their transmitters 3 to their receivers 5 and generate simulated conversation respecting the shopping experience orchestrated by the child.

Figure 10:
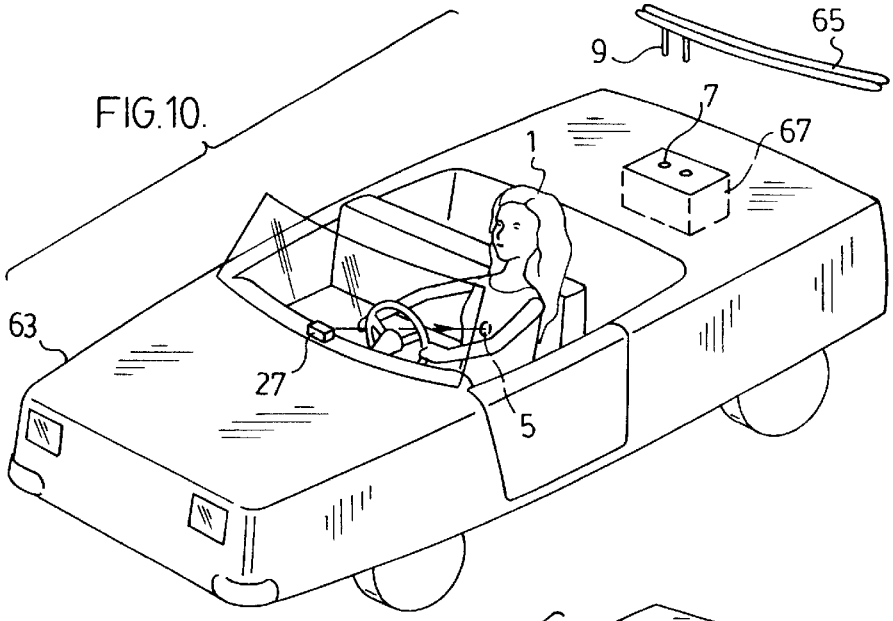
FIG. 10 is a schematic representation of a car activity center.

By the same token, the doll may be placed inside an automobile 63, as illustrated in FIG. 10. If an accessory such as a set of skis 65, a tennis racket, or other accessory item provided with pins 9 is placed on an accessory holder 67 on the car with corresponding receptacles 7, so that the accessory can be recognized by the activity center, the doll can comment upon the choice made and the kind of activity selected. For example, in the situation where skis are placed on the toy automobile, the doll will comment about favourable skiing conditions and what activities may occur at the ski lodge.

Figure 11:
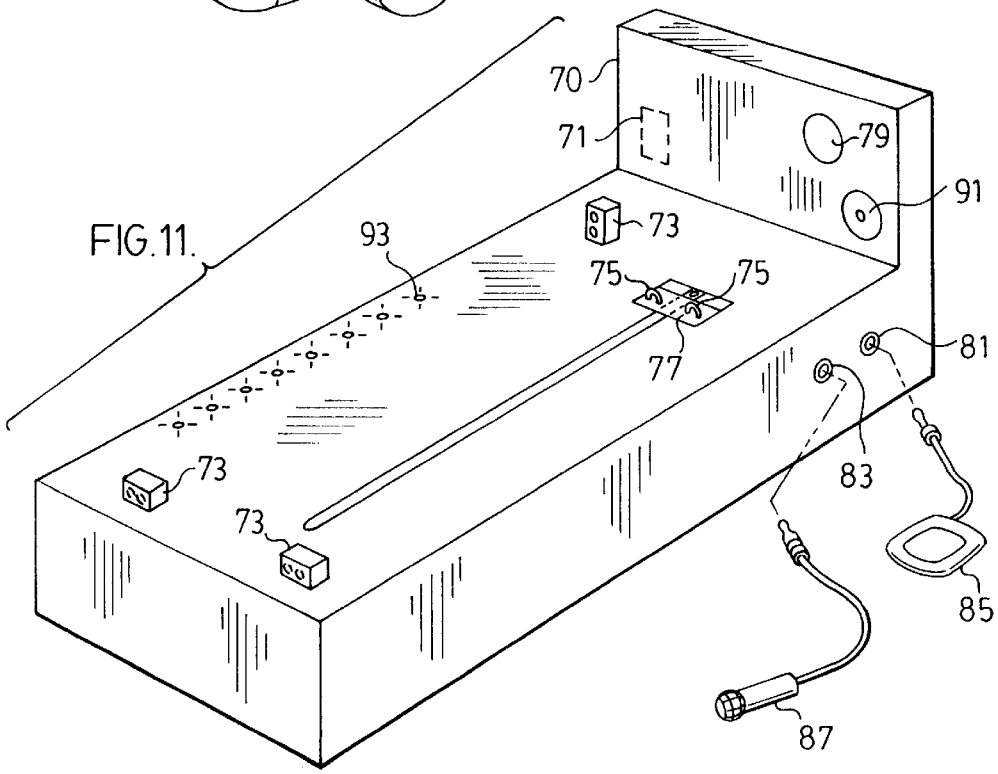
FIG. 11 is a schematic representation of a doll fashion runway activity center.

FIG. 11 illustrates a fashion runway activity center 70. In this embodiment, a library of information about a series of dolls and their costumes may be stored on an integrated circuit chip 71. Certain information may also be hard-wired into the individual dolls. For example, the doll's name and hairstyle will remain unchanged and can be hard-wired. Extra data respecting the particular dresses and accessories available to be worn by the doll can be recorded. When particular clothing or accessories are placed on the doll in a way in which the doll can recognize, a particular signal can be generated by the doll and transmitted to the activity center.

A series of transmitter/receiver units 73 may be located at various points on the runway activity center 70 so that the doll and runway can transmit and receive information when the doll is facing either backwards or forwards on the runway. The activity center may then announce the doll's name, hairstyle, dress and accessory.

The doll's feet can be placed in foot holders 75 on a platform 77 adapted to move backwards and forwards along the runway along a defined path under the control of an electric motor. A reset button 79 is provided so that the user can reset the runway when an activity is changed.

Every signal and movement requires energy, typically provided by electrical storage batteries (not shown). A particular power saver circuit (not shown) on the doll, which requires the child to trigger some device on the doll in order to activate the doll into sending a signal, can be used to save battery life. If battery life is not an issue, the doll can be left on, ready to send a signal at any time.

As a doll moves down the runway, which motion can be automated or manual, the pre-programmed comments selected can be played to generate a reasonable facsimile of a true fashion show.

The activity center 70 is provided with ports 81 and 83 adapted to receive electronic audio signals from external devices such as a CD player 85 and/or a microphone 87. By including a small public address system in the activity center, the child playing with the toy can include his or her own comments on the activity taking place. By use of an appropriate connection into the speaker system of the activity center, external sources of music, such as a CD player, can be directed through the speakers of the activity center. Thus, the child can create a fashion show complete with background music and the child's commentary using the microphone, to supplement the announcements and commentary generated within the activity center itself. Audio commentary and other sounds may be reproduced at speaker 91. The experience for the child may be enriched by adding lights 93 which may go on and off according to pre-programmed directions under the control of an integrated circuit.

Figure 12:
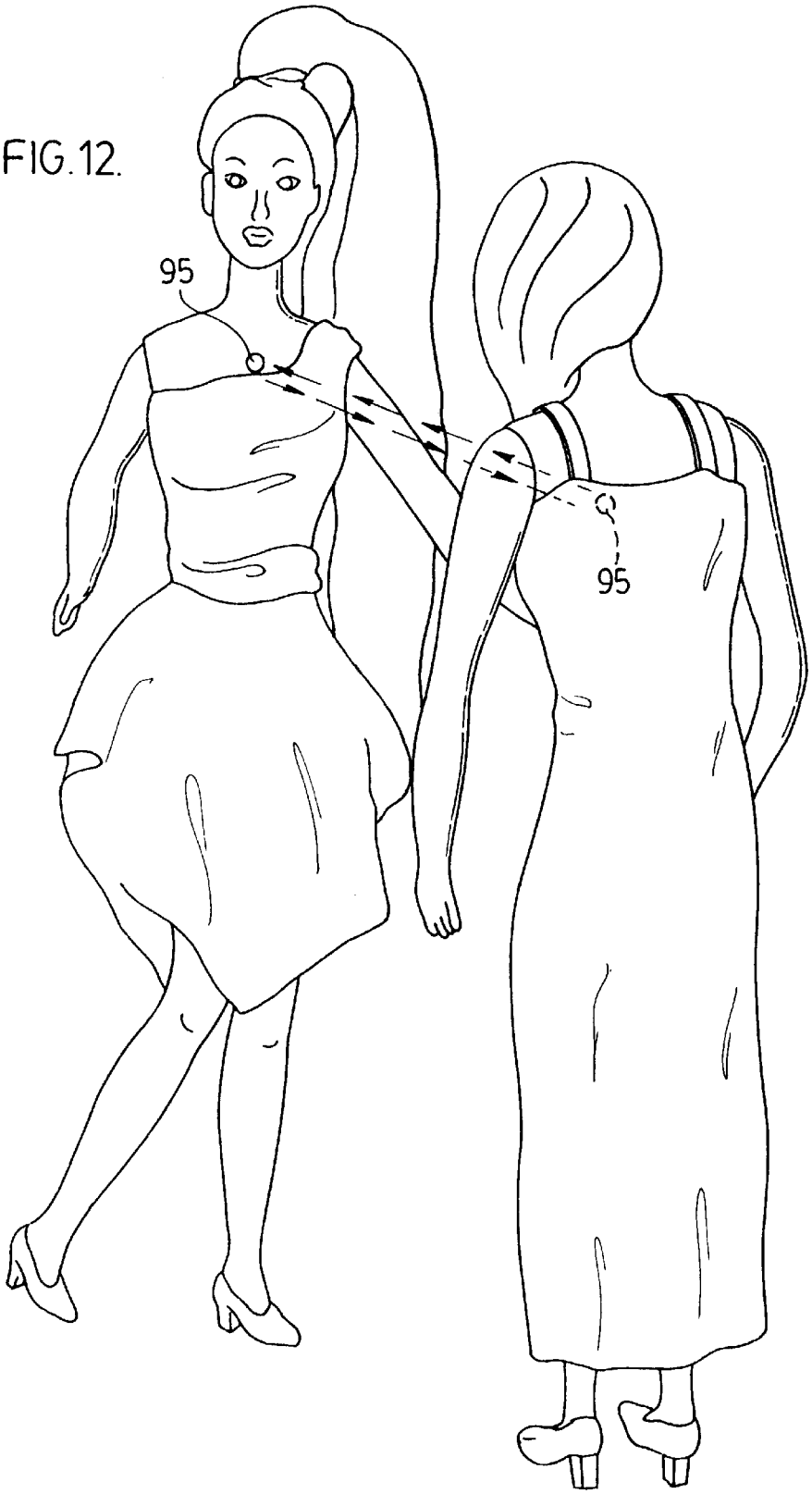
FIG. 12 is a schematic representation of two dolls exchanging information by means of infrared transmitter/receivers.

In the fashion context, two dolls wearing different clothing can be programmed to send signals to each other which can be received and recognized. Referring to FIG. 12, each doll may be provided with a combined transmitter/receiver unit 95 to permit back and forth communications. The signals can comprise the status of each doll including the hard-wired information, such as name and hairstyle, and the individually selected information, such as the clothing and accessories worn by the doll. The dolls can then comment about each other's choice of clothing and accessories, or activity, in the context of the fashion runway activity center.

Figure 13:
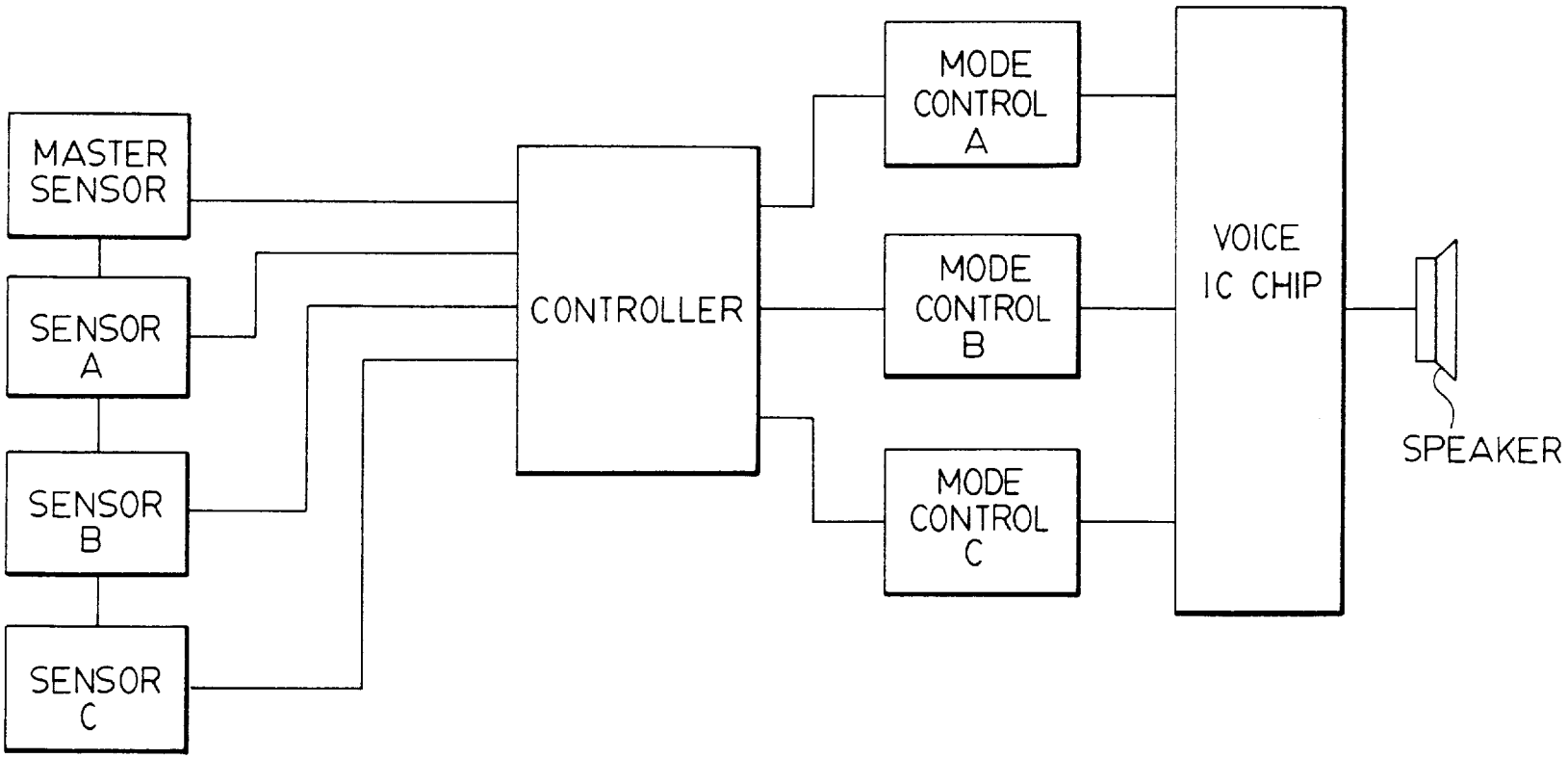
FIGS. 13 and 14 are schematic representations of arrangements of doll activity center sensors, controllers, integrated circuit chips and speakers.
Figure 14:
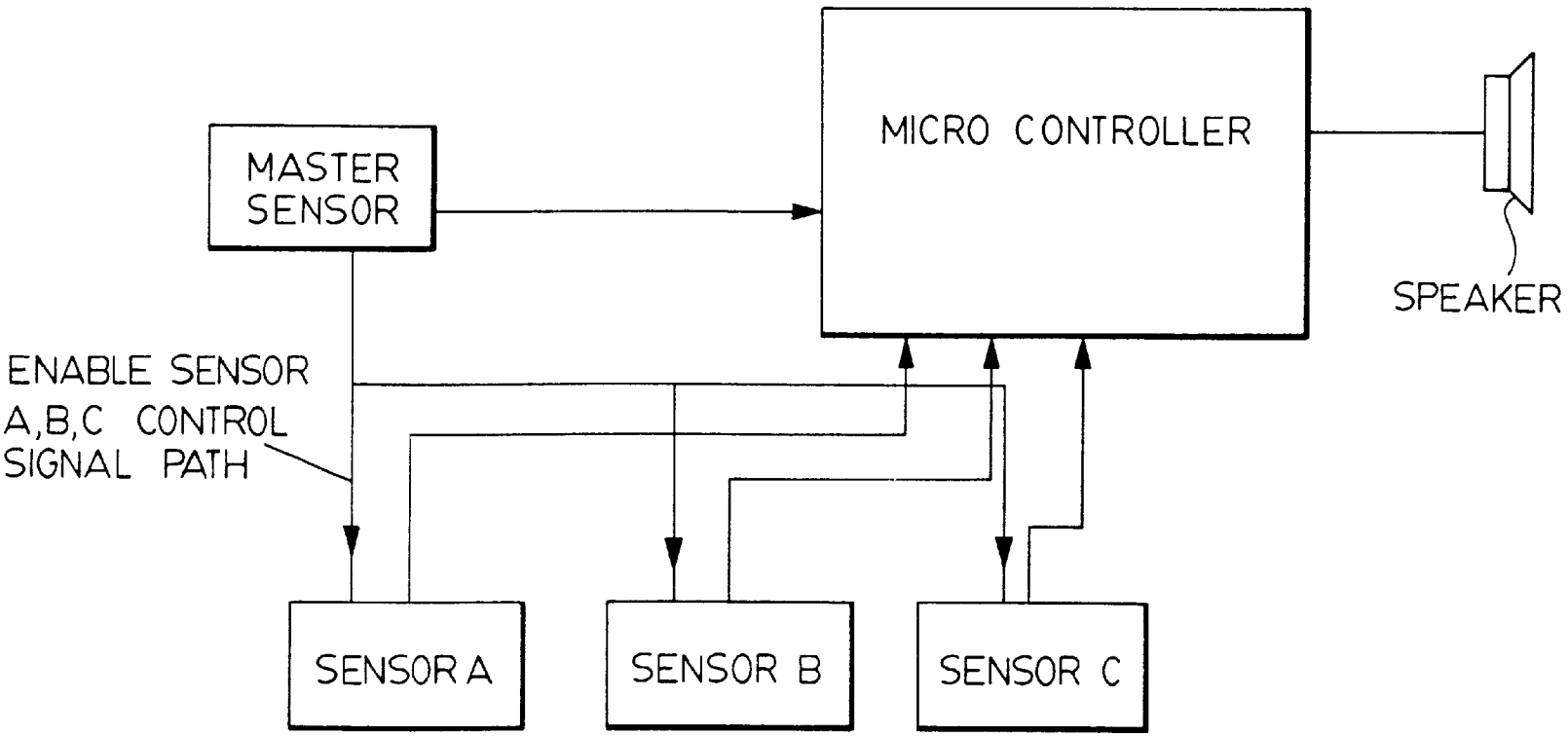

Sensor, computer controller, mode control, voice integrated circuit chip and speaker arrangements for dolls and for activity centers, as described above, are illustrated schematically in FIGS. 13 and 14.

Although particular embodiments of the invention have been described, modifications to these embodiments which fall within the spirit and scope of this invention will be apparent to those skilled in the art.

What is claimed is:

1. A toy set for a user, comprising:

a doll having a wireless receiver and audio means for storing and playing a plurality of prerecorded messages;

an activity center shaped to simulate an environment of the doll having a wireless transmitter for sending one of a plurality of predetermined signals to the doll and a microprocessor for determining the signal to be sent to the doll; and wherein at least one of the prerecorded messages corresponds to one or more of the predetermined signals and the audio means plays one of the prerecorded corresponding messages upon receiving one of the predetermined signals sent from the transmitter.

2. The toy set of claim 1, wherein the activity center includes at least one removable accessory and at least one sensor for sensing the presence of the accessory and signaling the microprocessor to transmit one of the predetermined signals to the doll.

3. The toy set of claim 1, wherein the audio means includes an integrated circuit and speaker combination.

4. The toy set of claim 3, wherein the prerecorded messages are stored in the integrated circuit.

5. The toy set of claim 1, wherein the audio means plays at least one of the prerecorded messages by artificial speech processing.

6. The toy set of claim 1, wherein at least one of the predetermined signals is an acceptable or unacceptable status signal.

7. The toy set of claim 6, wherein one of the prerecorded messages indicates to the user that the acceptable or unacceptable status signal has been received.

8. The toy set of claim 1, wherein the activity center is a fashion runway.

9. The toy set of claim 1, wherein the activity center is a kitchen.

10. The toy set of claim 1, wherein the activity center is an automobile.

11. The toy set of claim 1, wherein the doll further includes at least one removable accessory or item of clothing and at least one sensor for sensing the presence of the accessory or the item of clothing and signaling the audio means to play one of the prerecorded messages.

12. A toy set for a user, comprising:

an activity center having a wireless receiver and audio means for storing and playing a plurality of prerecorded messages;

a first doll having a first wireless transmitter for sending one of a plurality of first predetermined signals to the activity center;

a second doll having a second wireless transmitter for sending one of a plurality of second predetermined signals to the activity center; and wherein the activity center is shaped to simulate an environment for one of the dolls and at least one of the first and second prerecorded messages corresponds to one or more of the first and second predetermined signals respectively and the audio means plays one of the prerecorded corresponding messages upon receiving one of the first or second predetermined signals sent from the transmitter.

13. The toy set of claim 12, wherein the first doll includes at least one removable accessory and at least one sensor for sensing the presence of the accessory and signaling the transmitter to send one of the predetermined signals to the activity center.

14. The toy set of claim 12, wherein the audio means includes an integrated circuit and speaker combination.

15. The toy set of claim 14, wherein the prerecorded messages are stored in the integrated circuit.

16. The toy set of claim 12, wherein the audio means plays at least one of the prerecorded messages by artificial speech processing.

17. The toy set of claim 12, wherein the activity center is a fashion runway.

18. The toy set of claim 12, wherein the activity center is a kitchen.

19. The toy set of claim 12, wherein the activity center is an automobile.

20. The toy set of claim 12, wherein the activity center further includes at least one removable accessory and at least one sensor for sensing the presence of the accessory and signaling the audio means to play one of the prerecorded messages.

21. A toy set for a user, comprising:

a doll having a wireless receiver and audio means for storing and playing a plurality of prerecorded messages;

a toy stove having a wireless transmitter for sending one of a plurality of predetermined signals to the doll; and wherein at least one of the prerecorded messages corresponds to one or more of the predetermined signals and the audio means plays one of the prerecorded corresponding messages upon receiving one of the predetermined signals sent from the transmitter.

22. A toy set for a user, comprising:

a doll having a wireless receiver and audio means for storing and playing a plurality of prerecorded messages;

a toy car having a wireless transmitter for sending one of a plurality of predetermined signals to the doll; and wherein at least one of the prerecorded messages corresponds to one or more of the predetermined signals and the audio means plays one of the prerecorded corresponding messages upon receiving one of the predetermined signals sent from the transmitter.

23. A toy set for a user, comprising:

a doll having a wireless receiver and audio means for storing and playing a plurality of prerecorded messages;

a toy runway having a wireless transmitter for sending one of a plurality of predetermined signals to the doll; and wherein at least one of the prerecorded messages corresponds to one or more of the predetermined signals and the audio means plays one of the prerecorded corresponding messages upon receiving one of the predetermined signals sent from the transmitter.

* * * * *